US012031388B1

(12) United States Patent
Gahtani et al.

(10) Patent No.: US 12,031,388 B1
(45) Date of Patent: Jul. 9, 2024

(54) ALIGNMENT SUB-SYSTEM WITH RUNNING TOOL AND KNUCKLE JOINT

(71) Applicant: Saudi Arabian Oil Company, Dhahran (SA)

(72) Inventors: Saeed M. Gahtani, Dhahran (SA); Mohammed K. Muqri, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 53 days.

(21) Appl. No.: 18/091,225

(22) Filed: Dec. 29, 2022

(51) Int. Cl.
*E21B 17/05* (2006.01)
*E21B 33/04* (2006.01)
*E21B 19/06* (2006.01)

(52) U.S. Cl.
CPC ..... *E21B 17/05* (2013.01); *E21B 33/04* (2013.01); *E21B 19/06* (2013.01)

(58) Field of Classification Search
CPC ..... E21B 17/05; E21B 33/04; E21B 19/06
See application file for complete search history.

(56) References Cited

U.S. PATENT DOCUMENTS 2,285,213 A 6/1942 Bus
2,459,614 A * 1/1949 Brown ..... E21B 31/14 131/225
2,643,900 A * 6/1953 McBride ..... E21B 31/14 138/120
3,156,310 A 11/1964 Frisby
3,601,188 A 8/1971 McGlamery
4,700,778 A 10/1987 Smith et al.
4,928,762 A 5/1990 Mamke
4,953,617 A 9/1990 Ross et al.
4,986,362 A 1/1991 Pleasants
5,048,613 A 9/1991 Shilling
5,107,931 A 4/1992 Valka et al.
5,129,453 A 7/1992 Greenlee
6,571,877 B1 6/2003 Van Bilderbeek
6,920,926 B2 7/2005 York et al.
8,875,808 B2 11/2014 Cherry et al.
(Continued)

FOREIGN PATENT DOCUMENTS

GB 2540920 10/2020
WO WO-0238907 A2 * 5/2002 ..... E21B 17/02
WO WO 2014168623 10/2014

OTHER PUBLICATIONS nov.com [online], "Knuckle Joint," Nov Inc., available on or before Sep. 20, 2020, via Internet Archive: Wayback Machine URL <http://web.archive.org/web/20200920145137/https://www.nov.com/products/knuckle-joint>, retrieved on Oct. 1, 2021, <nov.com/products/knuckle-joint>, 5 pages.
(Continued)

*Primary Examiner* — James G Sayre
(74) *Attorney, Agent, or Firm* — Fish & Richardson P.C.

(57) ABSTRACT

An oil rig system includes a rotary table, an elevator and an alignment subsystem. The rotary table is aligned with a wellhead opening and is centered on a first axis. The elevator includes flexible links. The alignment subsystem has a running tool and a knuckle joint. The running tool has a first end and a second end. The running tool is configured to attach to a packoff body. The knuckle joint is attached to the first end of the running tool and is attached to the elevator. The knuckle joint is configured to angularly deflect.

31 Claims, 7 Drawing Sheets

(56) References Cited

U.S. PATENT DOCUMENTS

| | | | |
|---|---|---|---|
| 10,947,789 | B1 | 3/2021 | Al-Abdulrahman et al. |
| 2008/0202748 | A1 | 8/2008 | Bussear et al. |
| 2008/0308282 | A1 | 12/2008 | Standridge et al. |
| 2017/0260834 | A1 | 9/2017 | Chacon et al. |
| 2021/0071481 | A1 | 3/2021 | Al-Abdulrahman et al. |

OTHER PUBLICATIONS hunting-intl.com [online], "Knuckle Joints," Hunting Energy Services, available on or before Mar. 22, 2015, via Internet Archive: Wayback Machine URL <http://web.archive.org/web/20150322195645/http://www.hunting-intl.com/titan/wireline-hardware-and-accessories/knuckle-joints>, retrieved on Oct. 1, 2021, <http://www.hunting-intl.com/titan/wireline-hardware-and-accessories/knuckle-joints>, 1 page.

coilsolutions.com [online], "Knuckle Joint Assembly," Coil Solutions, available on or before Nov. 28, 2018, via Internet Archive: Wayback Machine URL <http://web.archive.org/web/20181128000036/http://www.coilsolutions.com/products/downhole-tools/drill-and-milling-tools/knuckle-joint/>, retrieved on Oct. 1, 2021, <http://www.coilsolutions.com/products/downhole-tools/drill-and-milling-tools/knuckle-joint/>, 4 pages.

PCT International Search Report and Written Opinion in International Appln. No. PCT/US2020/049868, dated Oct. 23, 2020, 11 pages.

* cited by examiner

ALIGNMENT SUB-SYSTEM WITH RUNNING TOOL AND KNUCKLE JOINT

TECHNICAL FIELD

This disclosure relates to an alignment subsystem having a packoff running tool and a knuckle joint.

BACKGROUND

Existing hanger pack-off running tools utilizes a solid drill pipe joint (sub) that attaches the pack-off body to the landing drill pipe. The rig floor rotary table is aligned fully with the wellhead below the rotary table. The pack-off is run and landed around the hanger.

SUMMARY

In certain aspects, an oil rig system includes a rotary table aligned with a wellhead opening. The rotary table is centered on a first axis. The oil rig system also includes an elevator having flexible links and an alignment subsystem. The alignment subsystem includes a running tool and a knuckle joint. The running tool has a first end and a second end. The running tool is configured to attach to a packoff body. The knuckle joint is attached to the first end of the running tool and is attached to the elevator. The knuckle joint is configured to angularly deflect.

Some system also include the packoff and/or a riser arranged in a wellhead. Some risers are arranged on a second axis and the second axis is parallel to the first axis and is offset from the first axis. Some systems also include a hanger having a landing surface. The hanger can be centered on the second axis.

In some systems, the alignment subsystem is configured to move from a first position to a second position. In the first position, the running tool can be aligned with the first axis. In the second position, the running tool can aligned with a second axis. The second axis is parallel to the first axis and is offset from the first axis. The knuckle joint can be configured to rotate to move the alignment subsystem from the first position to the second position. The knuckle joint can be configured to rotate to move the alignment subsystem from the second position to the first position.

In some systems, knuckle joint has a tensile capacity of about 10,000 psi to about 45,000 psi, a pressure capacity of about 3,000 psi to about 15,000 psi, a torsional capacity of 5,000 ft-lb to about 20,000 ft-lb, and/or a maximum deflection angle of about 5° to about 45°.

Some systems also include a computer system having a controller, one or more processors, a (non-transitory) computer-readable medium storing instructions executable by the one or more processors to perform operations. The operations include receiving deflection data. The deflection data contains at least a deflection angle between about 5° to about 45°. The operations also include transmitting instructions to a transceiver of the knuckle joint. The instructions contain the deflection angle.

In some systems, the elevator includes a series of flexible links and the elevator is configured to flex relative to the first axis. The elevator can have a relaxed position and a flexed position. In some embodiments, in the relaxed position of some, the elevator is arranged on and aligned with the first axis. In some embodiments, in the flexed position, the elevator is angled relative to the first axis. In the flexed position, the flexible can be flexed.

In certain aspects, an alignment subsystem includes a running tool, a knuckle joint, and a computer subsystem. The running tool, configured to attach to a packoff body, has a first end and a second end. The knuckle joint is attached to the first end of the running tool and is attached to an elevator. The knuckle joint is arranged on a first axis and is configured to angularly deflect by an angle. The computer subsystem includes a controller, one or more processors, and a computer-readable medium storing instructions executable by the one or more processors to perform operations. The operations include receiving deflection data. The deflection data contains at least a deflection angle. The operations also include transmitting instructions to a transceiver of the knuckle joint. The instructions contain the deflection angle.

In some systems, the alignment subsystem is configured to move from a first position to a second position. In the first position, the running tool can be aligned with the first axis. In the second position, the running tool can be aligned with a second axis. The second axis is parallel to the first axis and is offset from the first axis. The knuckle joint can be configured to rotate to move the alignment subsystem from the first position to the second position. The knuckle joint can be configured to rotate to move the alignment subsystem from the second position to the first position.

In some systems, knuckle joint has a tensile capacity of about 10,000 psi to about 45,000 psi, a pressure capacity of about 3,000 psi to about 15,000 psi, a torsional capacity of 5,000 ft-lb to about 20,000 ft-lb, and/or a maximum deflection angle of about 5° to about 45°.

The details of one or more embodiments are set forth in the accompanying drawings and the description below. Other features, objects, and advantages will be apparent from the description and drawings, and from the claims.

DESCRIPTION OF DRAWINGS

Like reference symbols in the various drawings indicate like elements.

DETAILED DESCRIPTION

The disclosed system includes an alignment system for adjusting the position of a pack-off tool relative to a rotary table and wellhead. In some configurations, a wellhead and a rotary table are offset, for example centered on two parallel, but offset axes. The offset depends on hole (wellbore) size, rig size, and riser to rotary level. Generally, the offset is between 0.01 inches and 24 inches. In such a configuration, the system can adjust the alignment of the packoff running tool and packoff body (tool) after passing through the rotary table, using a knuckle joint. The knuckle joint connects the pack-off running tool and an elevator of the rig system. In a first position of the alignment subsystem, the knuckle joint is vertical, aligning the packoff running tool on a first axis, on which the rotary table is centered. After passing through the rotary table, the knuckle joint rotates or tilts by a predetermined angle to transition the alignment subsystem into a second position. In the second position, the packoff running tool aligns with a second axis defined by the wellhead. The packoff tool can then be inserted into the wellhead and deliver a packoff to a hanger in the wellhead.

Figure 1:
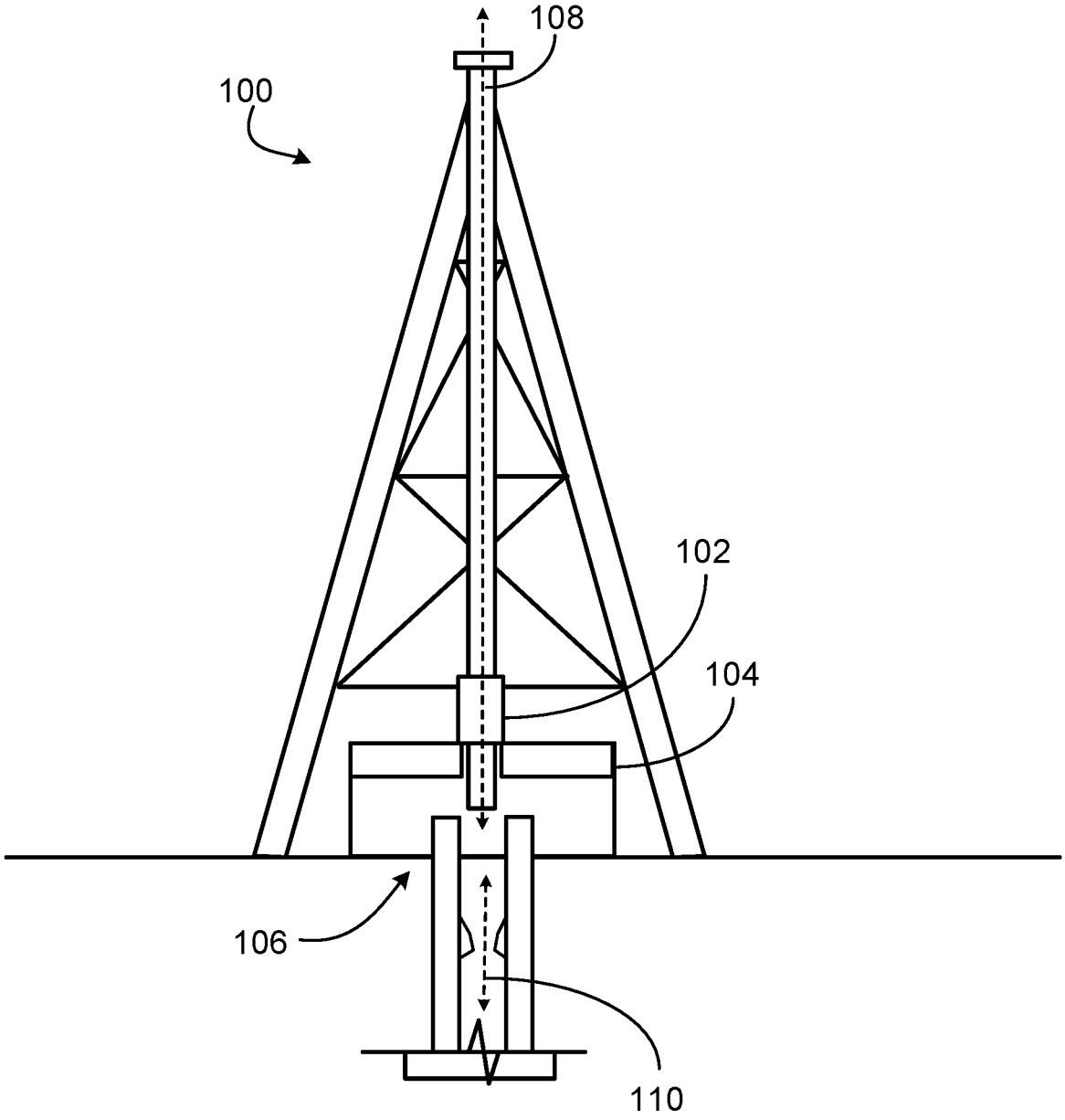
FIG. 1 is a view of a rig system having an alignment subsystem.

FIG. 1 is a view of a rig system 100 having an alignment subsystem 102. The rig system 100 includes a rotary table 104 arranged above a wellhead opening 106. The rotary table 104 has an opening 104*a* centered on a first axis 108. The wellhead opening 106 is centered on a second axis 110. The second axis 110 is parallel to the first axis 108 and offset from the first axis 108 by a distance d. In operation, the alignment subsystem 102 is aligned with the first axis 108 in a first position and is aligned with the second axis 110 in the second position.

Figure 2:
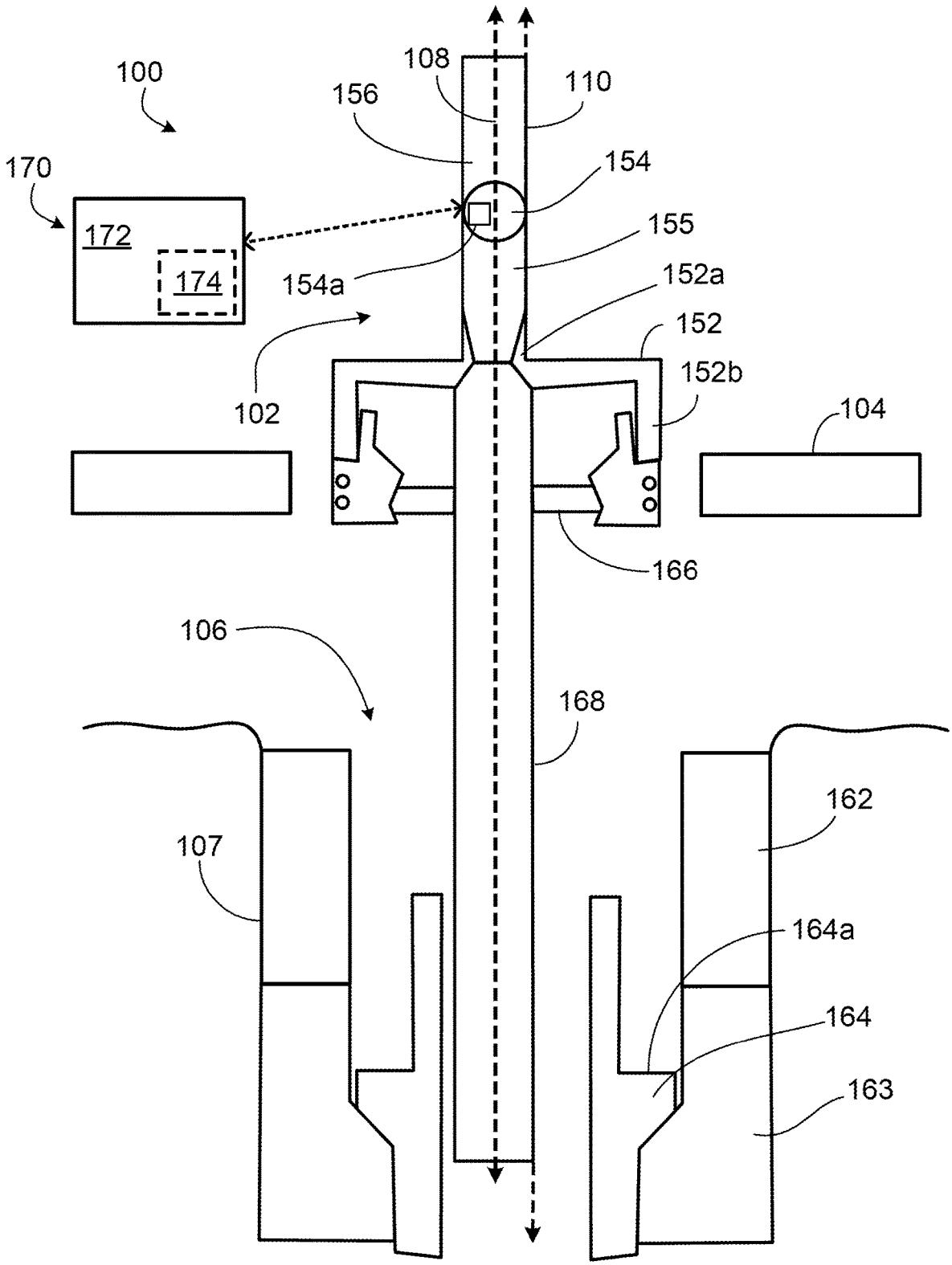
FIG. 2 is a cross sectional view of an alignment subsystem of the rig system with a pack off running tool with a knuckle joint.

FIG. 2 is a cross sectional view of alignment subsystem 102 with a pack off running tool 152 connected to a knuckle joint 154 by a connecting pipe 155. The alignment subsystem 102 is connected to an elevator 156 by the knuckle joint 154. The knuckle joint 154, elevator 156, connecting pipe 155, and pack off running tool 152 are initially aligned with the first axis 108 that is defined by the rotary table 104.

The system 100 is arranged over the opening 106 of the wellhead 107 and includes a riser 162 arranged in the wellhead 107. The riser 162 is centered on the second axis 110. A spool 163 is arranged in the wellhead 107 downhole relative to the riser 162. A hanger 164 is also arranged in the wellhead and connected to the spool 163. The riser 162, spool 163, and hanger 164 are each centered on the second axis. The hanger 164 is arranged concentrically within the spool and forms a landing surface 164*a* for receiving a packoff tool.

The packoff running tool 152 has a first end 152*a* and a second end 152*b*. The first end 152*a* is attached to the connecting pipe 155 at a fixed angle, for example a 0° angle. In this configuration, the connecting pipe 155 and the pack off running tool 152 are aligned on a single axis, for example the first axis, the second axis, or a different axis. The second end 152*b* of the packoff running tool 152 is releasably attached to the packoff body 166. When connected, the packoff running tool 152 can translate axially, rotate, or tilt the packoff body 166. The packoff body 166 includes seals 167 that can be actuated to seal the packoff body 166 to the hanger 164 and/or spool 163. In use, the packoff body 166 is run in the wellhead 107 by the packoff running tool 152 and is landed in the hanger 164 at the landing surface 164*a*.

The knuckle joint 154 attaches to the first end 152*a* of the running tool by the connecting pipe 155 and attaches to the elevator 156 such that the knuckle joint 154 is arranged between the pack off running tool 152 and the elevator 156. The knuckle joint 154 is angularly deflectable to control the position and angle of the packoff running tool 152 relative to the first axis 108. The knuckle joint 154 has a tensile capacity of about psi to about 45,000 psi (e.g., about 5,000 psi to about 150,000 psi). The knuckle joint 154 may have a pressure capacity of about 3,000 psi to about 15,000 psi. The knuckle joint 154 has a torsional capacity of about 5,000 ft-lb to about 20,000 ft-lb (e.g., about 5,000 ft-lb to about 50,000 ft-lb). The knuckle joint 154 has a maximum deflection angle of about 5° to about 45° (e.g., about 5° to about 90°).

Figure 3A:
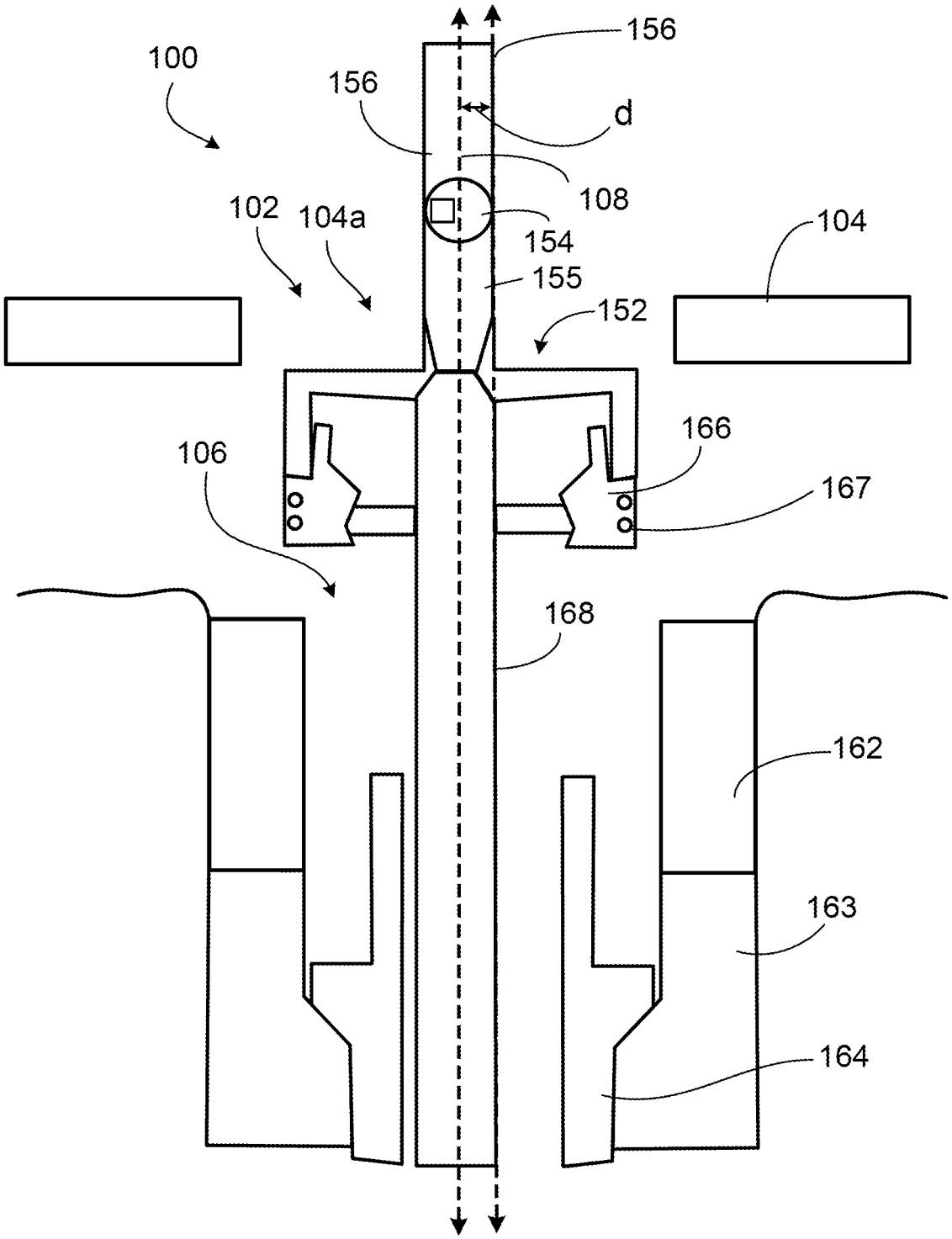
FIGS. 3A-3E are views of the operational stages of the alignment subsystem, in use.
Figure 3B:
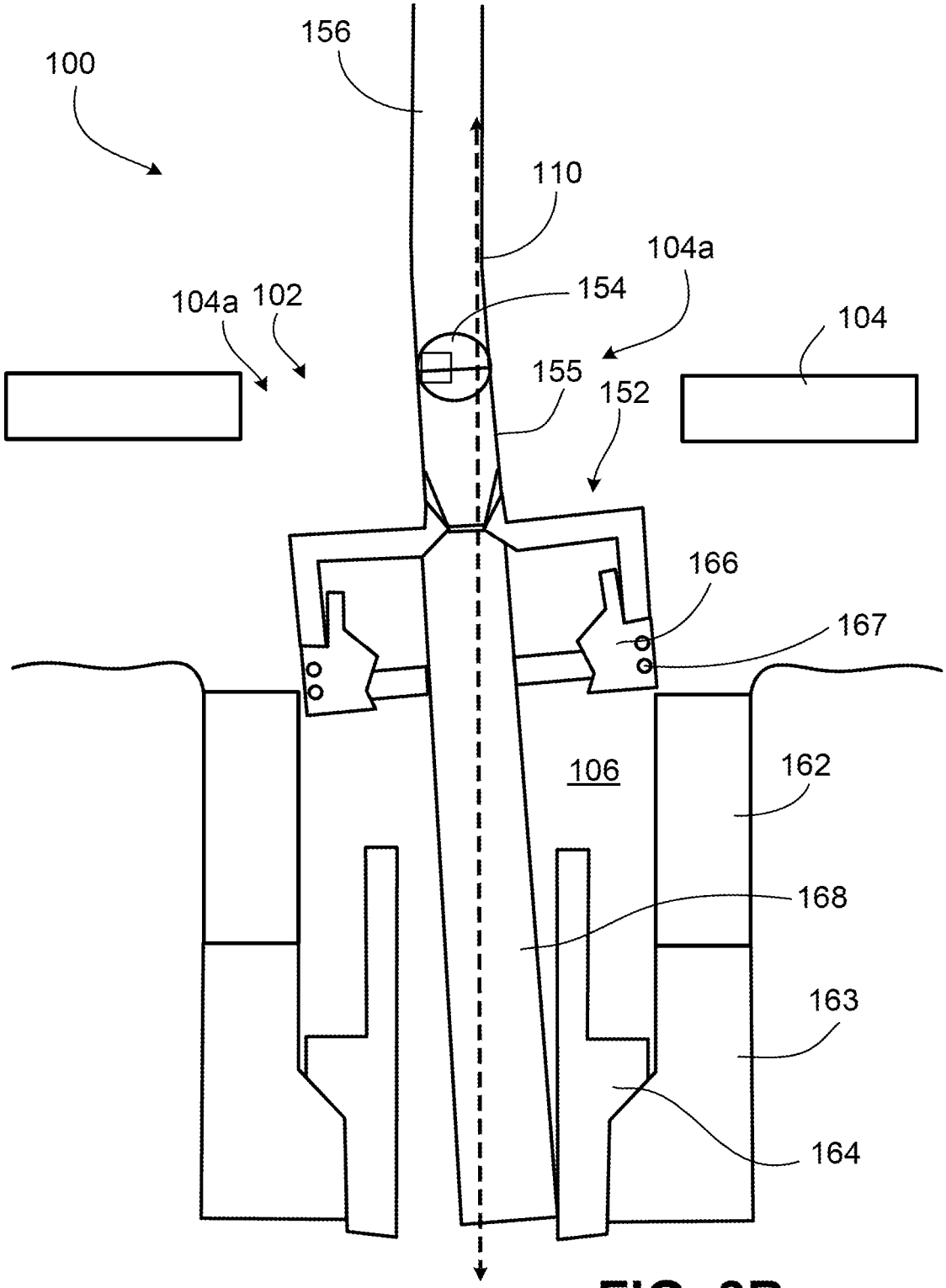
Figure 3C:
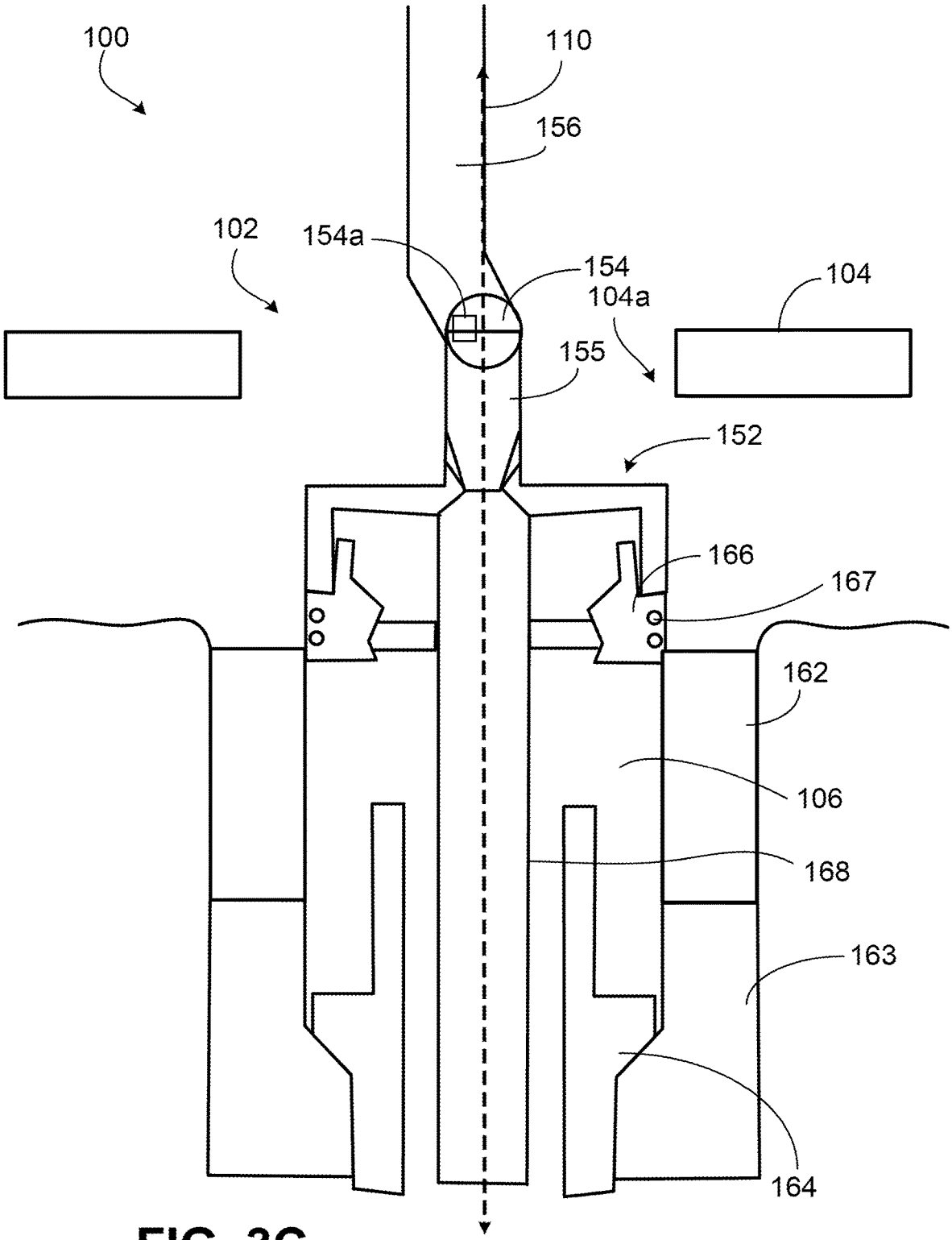
Figure 3D:
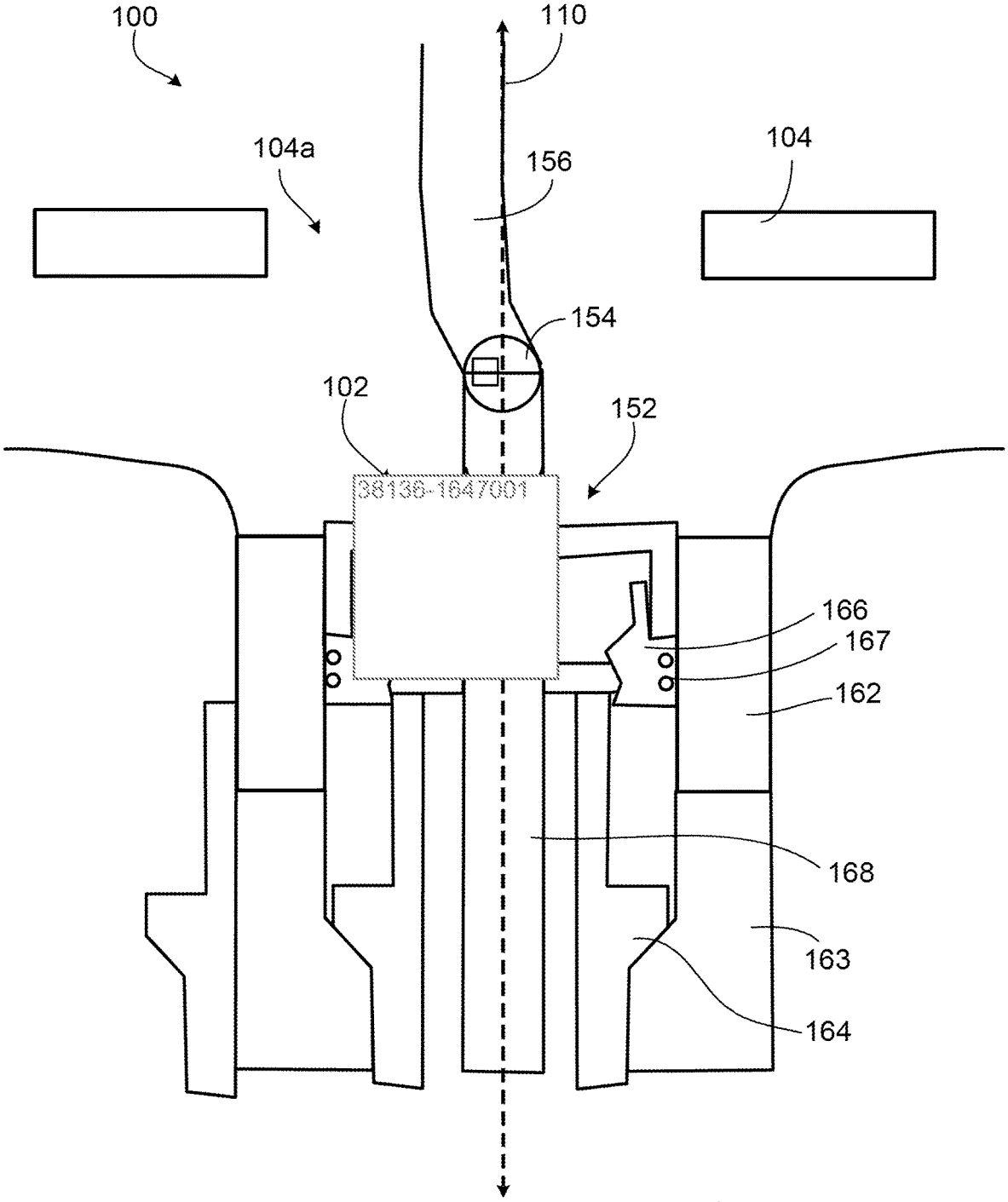
Figure 3E:
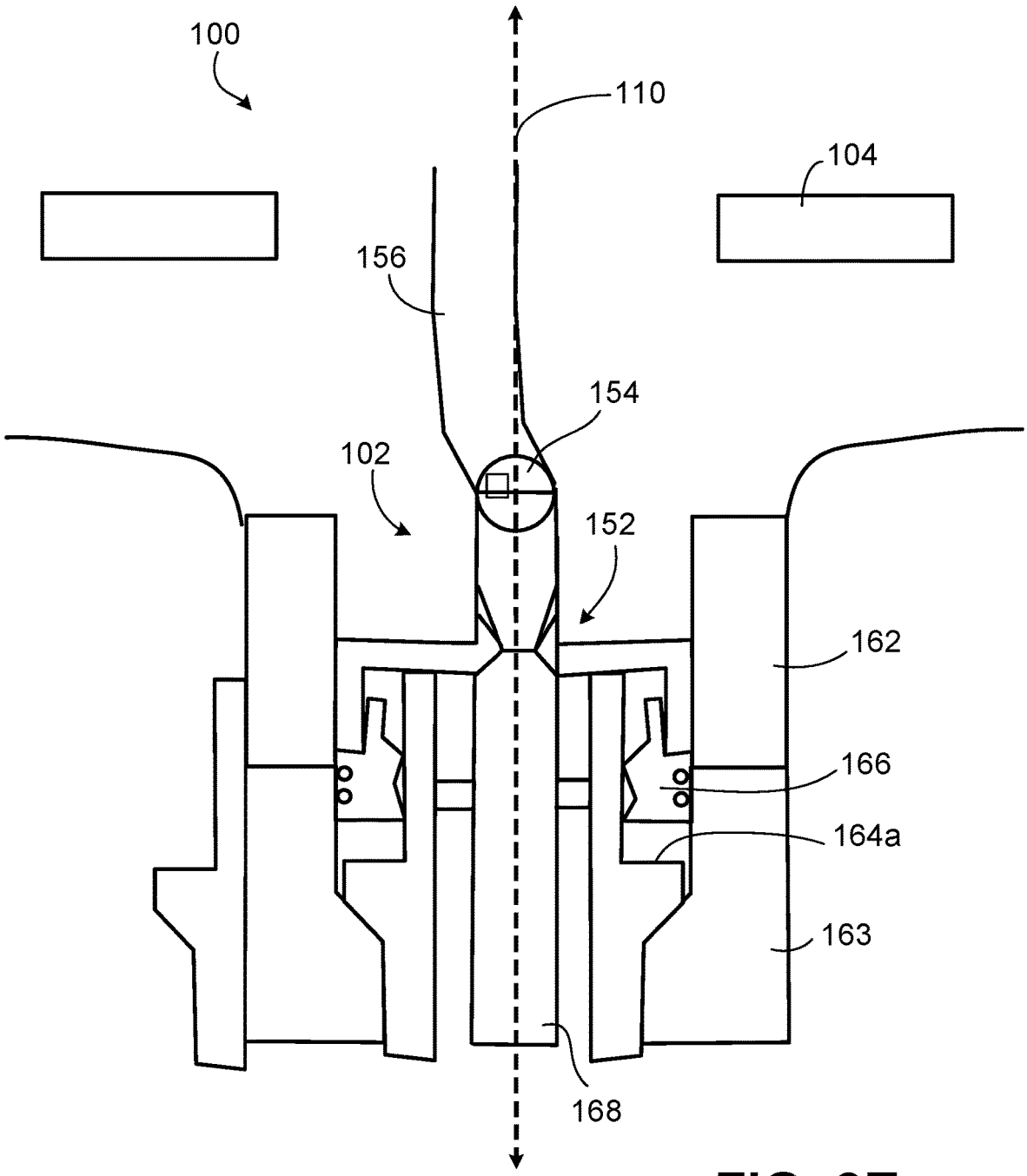

The alignment subsystem 102 is configured to move from a first position to a second position, shown with reference to FIGS. 3A and 3E. In the first position, the alignment subsystem 102 is aligned with the first axis 108. In the second position, the alignment subsystem 102 is aligned with the second axis 110. The knuckle joint 154 is configured to rotate to move the alignment subsystem 102 from the first position to the second position and from second position to the first position. To move or rotate the knuckle joint, the knuckle joint can include a motor, a hydraulic press, or magnetic forces.

The alignment subsystem 102 includes position sensors operable to generate and transmit position and/or deflection data indicative of the position of the knuckle joint the elevator, the packoff running tool, the wellbore, the wellbore opening, the rotary table, the opening of the rotary table, the drill string first axis, and/or second axis relative to the alignment subsystem or position sensors. In some sensors, the transmitted data includes the position of any of the knuckle joint, the elevator, the packoff running tool, the wellbore, the wellbore opening, the rotary table, the opening of the rotary table, the drill string first axis, and/or second axis relative to another of the knuckle joint, the elevator, the position of the packoff running tool, the wellbore, the wellbore opening, the rotary table, the opening of the rotary table, drill string first axis, and/or second axis relative to the alignment subsystem or position sensors. In some sensors, the position and/or deflection data includes a predetermined deflection angle determined by a controller of the sensor.

The elevator 156 includes multiple flexible links or a hinge that can deflect the elevator 156 from the first axis 108 or tilt the elevator 156 relative to the first axis 108. Tilting the elevator 156 also tilts any assemblies, subsystems, or components arranged downhole of the elevator 156. The elevator 156 is configured to covey or press the alignment subsystem 102 downwards through the opening 104*a* of the rotary table 104 and the wellhead 107. The elevator 156 is also configured to covey or pull the alignment subsystem 102 from the wellhead 107 after landing the packoff tool 166.

The system 100 includes a drill pipe 168 attached to the pack off running tool 152 and a computer system 170. The drill pipe 168 assists the elevator 156 in pulling the alignment subsystem into the 107 by acting as a weight. The drill pipe density and/or weight can depend on the string available and/or on the landing weight required per size. The drill pipe has a weight between 1,000 lbs and 45,000 lbs. The computer system 170 includes a controller 172 and at least one processor 174. The computer system 170 is operatively connected to the alignment subsystem 102 and the elevator 156 to control the alignment subsystem 102 and the elevator 156. A computer-readable medium storing instructions is executable by the processors to perform operations (e.g., a non-transitory computer readable medium). The operations include receiving deflection data from the alignment subsystem 102 and transmitting instructions to a transceiver 154*a* of the knuckle joint 154. The deflection data is indicative of the deflection of the alignment subsystem 102 relative to the first and/or second axis. In some cases, the deflection is relative to a vertical axis. The deflection data may be input manually, determined by the computer system 170, or by the alignment subsystem 102. The operations also include determining a deflection angle that would realign the alignment subsystem 102 with the first and/or second axis. The instructions sent by the computer system 170 to the knuckle joint 154 contain the predetermined deflection angle. In some system, the alignment subsystem includes the computer system.

FIGS. 3A-3E are views of the operational stages of the alignment subsystem 102, in use. FIG. 3A is a view of the alignment subsystem 102 in a first position, passing through the opening 104*a* of the rotary table 104. In the first position, the alignment subsystem 102 is arranged on and aligned with the first axis 108 defined by the rotary table 104. The knuckle joint 154 orients the packoff running tool 152 and packoff body 166 so that the packoff running tool 152 and packoff body 166 can be conveyed through the opening 104*a* of the rotary table 104 by the elevator 156. The links in the elevator 156 are in a relaxed position. In the relaxed position, are unflexed and align the elevator 156 with the first axis 108.

FIG. 3B is a view of the alignment subsystem 102 in transition from the first position to the second position. To pass through the opening 106 of the wellhead 107 and land the packoff tool 166 (packoff body), the alignment subsystem 102 must enter the wellhead 107 along the second axis at a 0°, or near zero, tilt relative to the second axis 110. The links in the elevator 156 flex into a flexed position. In the flexed position, the links deflect the elevator 156 from the first axis 108 and radially translate the alignment subsystem 102 onto the second axis 110. The links may be flexed or relaxed manually or electronically. In this configuration the alignment subsystem 102 intersects, but does not align with the second axis 110. The alignment subsystem 102 is tilted at an angle relative to the second axis 110. The links continue to flex until the knuckle joint 154 of the alignment subsystem 102 is arranged on the second axis 110. The elevator links move due to the hydraulic system of the top drive. The alignment subsystem may be at non-zero angle relative to the second axis 110.

FIG. 3C is a view of the alignment subsystem 102 in the second position aligned with the entrance to the wellhead 107. As the knuckle joint 154 is centered on (e.g., intersects) the second axis 110, the knuckle joint 154 is manually or mechanically adjusted to tilt the alignment subsystem 102, packoff tool 166, and drill pipe 168 to align with and be centered on the second axis 110. In this second position, the alignment subsystem 102 and packoff tool 166 are insertable into the wellhead 107 through the riser 162.

FIG. 3D is a view of the alignment subsystem 102 in the second position inserted into the wellhead 107. The links in the elevator 156 and the knuckle joint are locked into position and the elevator 156 runs the alignment subsystem 102, the packoff tool 166, and the drill pipe 168 through the riser 162 and hanger 164. The packoff running tool 152 continues into the wellhead 107 until the packoff tool 1166 abuts the landing surface 164*a* of the hanger 164. FIG. 3E is a view of the alignment subsystem 102 in the second position with the landed packoff tool 166. The packoff tool 166 engages seals 167 and disconnects from the packoff running tool 152.

A method for operating an alignment subsystem with a knuckle joint is described herein. The method is described with reference to the system 100 however, the method can be used with any applicable system. Initially, the drill pipe 168 is at least partially inserted into the hanger 164. The drill pipe 168, alignment subsystem 102, and elevator 156 are aligned with the first axis 108. The first axis 108 is defined by the opening 104*a* of the rotary table 104. The second axis 110, defined by the wellhead 107, is parallel and offset from the first axis 108, such that the opening 104*a* of the rotary table 104 and the opening 106 of the wellhead 107 overlap, but do not align. The offset d between the first and second axis is about 2 inches to about 8 inches. Some offsets are, for example, about 1 inch to about 10 inches, about 4 inches to about 24 inches, about 4 inches to about 12 inches, about 4 inches to about 8 inches, about 5 inches to about 24 inches, about 6 inches to about 24 inches, about 8 inches to about 24 inches, about 10 inches to about 24 inches, about 12 inches to about 24 inches, about 18 inches to about 24 inches, about 6 inches to about 12 inches, about 6 inches to about 18 inches, about 12 inches to about 16 inches, greater than 1 inch, greater than 2 inches, greater than 3 inches, greater than 4 inches, greater than 5 inches, greater than 6 inches, greater than 7 inches, greater than 8 inches, greater than 9 inches, greater than 10 inches, greater than 11 inches, greater than 12 inches, greater than 18 inches, or greater than 24 inches.

The elevator runs the alignment subsystem 102, packoff tool 166, and drill pipe 168 downhole, in a first direction, past the rotary table 104. The weight of the drill pipe 168 assists the elevator 156 in moving the alignment subsystem 102 and the packoff running tool 152 in the first downhole direction. After the first end 152*a* of the packoff running tool 152 passes the rotary table 104, the links of the elevator may be hydraulically adjusted to radially move the alignment subsystem 102, packoff tool 166, and drill pipe 168. Some elevator links are electronically or manually adjusted. The links continue to flex or tilt until the knuckle joint 154 is arranged on the second axis 110. The computer system can control the deflection of the links. The links then lock to hold the elevator 156 in the flexed position. Deflection data can be generated by the alignment subsystem or by the computer system. The deflection data include the angle of deflection experienced by the alignment subsystem due to the flex of the links. The deflection data also include a predetermined deflection angle that would align the alignment subsystem with the second axis. The knuckle joint 154 receives, from the computer system 170, instructions containing the predetermined deflection angle. The knuckle joint 154 is electrically or manually adjusted to deflect at the predetermined angle. The predetermined angle may be between about 0.1° and about 90° to center the pack-off body on the second axis. For example, the predetermined angle may be between about to about 90°, about 1° to about 10°, about 0.1° to about 0.5°, about 0.1° to about 1°, about 0.5° to about 15°, about 10° to about 15°, about 10° to about 20°, about 15° to about about 15° to about 45°, about 10° to about 90°, about 15° to about 30°, about 1° to about 30°, about 1° to about 20°, about 0.1° to about 20°, about 0.1° to about 30°, about 5° to about 45°, about 30° to about 90°, about 30° to about 60°, about 1° to about 70°, about to about 25°, about 3° to about 9°, about 4° to about 16°, or about 2° to about 90° relative to the second axis. The knuckle joint 154 is locked at the predetermined angle so that the alignment subsystem 102 is aligned with the second axis 110 and insertable into the opening 106 of the wellhead 107.

The elevator 156 conveys the alignment subsystem 102 into the wellhead until the packoff tool 166 reaches the landing surface of the hanger 164. The packoff tool 166 engages seals 167 with the hanger 164 and spool 163 to attach the packoff body 166 to the hanger 164 and spool 163. The packoff tool 166 is disengaged from the packoff running tool 152 and the packoff running tool 152 can be removed with the drill pipe.

The elevator 156 conveys the alignment subsystem 102 into the wellhead until the packoff tool 166 reaches the landing surface of the hanger 164. The packoff tool 166 engages seals 167 with the hanger 164 and spool 163 to attach the packoff body 166 to the hanger 164 and spool 163. The packoff tool 166 is disengaged from the packoff running tool 152 and the packoff running tool 152 can be removed with the drill pipe.

To remove the alignment subsystem 102 from the wellhead, the elevator 156 conveys the alignment subsystem 102 in a second, uphole direction. The second direction is opposite the first direction. The knuckle joint 154 holds the deflection angle until the second end 152*b* of the packoff running tool 152 exits the riser 162 of the wellhead 107. The knuckle joint 154 and links are returned to the starting angles (e.g., 0°) and are realigned with the first axis 110. The elevator then conveys the alignment subsystem 102 in the second direction so that the second end 152*b* of the packoff running tool 152 exits the opening 104*a* of the rotary table 104. The alignment subsystem 102 can then be removed or adjusted by an operator. After use, the pack-off running tool can be removed and/or redressed for future reuse.

In some system include a different tool or sub-system that lands equipment into the wellhead or wellbore. For example, rather than or in addition to a packoff tool, the system can include landing test plugs and/or hangers. The system can operate similarly to the system 100 to identify an offset and realign the tool or sub-system manually or via a computer sub-system (automatically).

In some systems, the knuckle joint tilts as the links in the elevator are flexed. For example, the knuckle joint may move or tilt at the same rate as the links of the elevator so that the drill pipe remains parallel to the first axis and/or second axis.

While the system has been described as an electronic or automated system, some systems are semimanual or fully manual. For example, such a system can be manually adjusted by an operator. In such a system, the drill pipe is at least partially inserted into the hanger. The drill pipe, alignment subsystem, and elevator are aligned with the first axis, defined by the opening of the rotary table. The second axis, defined by the wellhead, is parallel and offset from the first axis, such that the opening of the rotary table and the opening of the wellhead overlap, but do not align. The offset d between the first and second axis is about 0.01 inches to about 24 inches (e.g., about or greater than 3 inches, e.g., about 3 inches to about 12 inches, e.g., about 4 inches).

The elevator runs the alignment subsystem, packoff tool, and drill pipe downhole, in a first direction, past the rotary table. The weight of the drill pipe assists the elevator in moving the alignment subsystem and the packoff running tool in the first downhole direction. After the first end of the packoff running tool passes the rotary table, an operator flexes the links of the elevator to radially move the alignment subsystem, packoff tool, and drill pipe. The links continue to flex or tilt until the operator sees knuckle joint is arranged in the center of the wellhead, on the second axis. The links then lock to hold the elevator in the flexed position.

Next, the packoff running tool, drill pipe, and alignment subsystem are run further downhole so that the packoff running tool abuts the wellhead or a riser in the wellhead. The packoff running tool, drill pipe, and alignment subsystem continue downhole applying more pressure to the packoff running tool and drill pipe until the knuckle joint flexes to release the force. The knuckle joint will continue to flex until the pack off running tool is aligned with the opening of the well head. The elevator or operator conveys the alignment subsystem into the wellhead until the packoff tool reaches the landing surface of the hanger. The packoff tool engages seals with the hanger and spool to attach the packoff body to the hanger and spool. The packoff tool is disengaged from the packoff running tool and the packoff running tool can be removed.

In some cases, the predetermined angle of the knuckle is measured, calculated, and preset by an operator. In such an embodiment, the operator measures the offset between the rotary table and the wellhead and calculates the required deflection angle of the knuckle joint. The operator then manually adjusts the knuckle joint to the calculated deflection angle and locks the knuckle joint, for example by using pins. In this system, the knuckle joint includes a locking sub-system comprising a locking pin and a recess in the knuckle joint for receiving a locking pin. The locking pin, when inserted into the knuckle joint, structurally locks the knuckle joint at an angle. An angle of deflection relative to an axis defined by the drill string or elevator links may be determined by position sensors in the knuckle joint and/or an alignment sub-system. The angle of deflection can be displayed on a screen or connected display to assist the operator in manually adjusting the knuckle joint to the measured, calculated, or predetermined angle. At this stage the links of the elevator are aligned with the first axis and the packoff running tool is tilted at the calculated angle and aligned with the second axis.

In systems where the string assembly is "made up" or assembled, the operator connects components of the string assembly at connection points to form the string assembly. In the system with a pack-off running tool, the operator makes up or connects the knuckle joint of the string assembly to the pack-off running tool. The operator then runs the pack off running tool, flexing the links of the elevator so that the packoff running tool, drill pipe, and alignment subsystem align with the first axis and pass through the opening of the rotary table. After the packoff running tool passes the rotary table, the operator realigns the links on the first axis so that the packoff running tool, drill pipe, and alignment subsystem are aligned with the second axis.

The elevator or operator conveys the alignment subsystem into the wellhead until the packoff tool reaches the landing surface of the hanger. The packoff tool engages seals with the hanger and spool to attach the packoff body to the hanger and spool. The packoff tool is disengaged from the packoff running tool and the packoff running tool can be removed.

In some embodiments, the system comprises a first knuckle joint and a second knuckle joint. The system, automatically via the controller or manually via the operator, may prompt each knuckle joint to rotate so that the pack off running tool aligns with the first axis and/or the second axis.

A number of embodiments have been described. Nevertheless, it will be understood that various modifications may be made without departing from the spirit and scope. Accordingly, other embodiments are within the scope of the following claims.

What is claimed is:

1. An oil rig system comprising:

a rotary table aligned with a wellhead opening, the rotary table centered on a first axis;

an elevator; and an alignment subsystem comprising:

a running tool having a first end and a second end, the running tool configured to attach to a packoff body; and a knuckle joint attached to the first end of the running tool and attached to the elevator, the knuckle joint configured to angularly deflect.

2. The oil rig system of claim 1, further comprising the packoff.

3. The oil rig system of claim 1, further comprising a riser arranged in a wellhead.

4. The oil rig system of claim 3, wherein the riser is arranged on a second axis, wherein the second axis is parallel to the first axis and is offset from the first axis.

5. The oil rig system of claim 3, further comprising a hanger having a landing surface.

6. The oil rig system of claim 5, wherein the hanger is centered on the second axis.

7. The oil rig system of claim 1, wherein the alignment subsystem is configured to move from a first position to a second position.

8. The oil rig system of claim 7, wherein in the first position, the running tool is aligned with the first axis.

9. The oil rig system of claim 7, wherein in the second position, the running tool is aligned with a second axis, wherein the second axis is parallel to the first axis and is offset from the first axis.

10. The oil rig system of claim 7, wherein the knuckle joint is configured to rotate to move the alignment subsystem from the first position to the second position.

11. The oil rig system of claim 7, wherein the knuckle joint is configured to rotate to move the alignment subsystem from the second position to the first position.

12. The oil rig system of claim 1, wherein the knuckle joint has a tensile capacity of about 10,000 psi to about 45,000 psi.

13. The oil rig system of claim 1, wherein the knuckle joint has a pressure capacity of about 3,000 psi to about 15,000 psi.

14. The oil rig system of claim 1, wherein the knuckle joint has a torsional capacity of 5,000 ft-lb to about 20,000 ft-lb.

15. The oil rig system of claim 1, wherein the knuckle joint has a maximum deflection angle of about 5° to about 45°.

16. The oil rig system of claim 1, further comprising a computer system comprising:

a controller; and one or more processors, a computer-readable medium storing instructions executable by the one or more processors to perform operations, the operations comprising:

receiving deflection data, wherein the deflection data contains at least a deflection angle between about 5° to about 45°; and transmitting instructions to a transceiver of the knuckle joint, wherein the instructions contain the deflection angle.

17. The oil rig system of claim 1, wherein the elevator comprises a series of movable links, wherein the elevator is configured to flex relative to the first axis.

18. The oil rig system of claim 17, wherein elevator has a relaxed position and a flexed position.

19. The oil rig system of claim 18, wherein, in the relaxed position of the elevator, the elevator is arranged on and aligned with the first axis.

20. The oil rig system of claim 18, wherein, in the flexed position of the elevator, the elevator is angled relative to the first axis.

21. The oil rig system of claim 20, wherein, in the flexed position of the elevator, the movable links of the elevator are flexed.

22. An alignment subsystem comprising:

a running tool having a first end and a second end, the running tool configured to attach to a packoff body;

a knuckle joint attached to the first end of the running tool and attached to an elevator, the knuckle joint configured to angularly deflect by an angle, wherein the knuckle joint is arranged on a first axis; and a computer system comprising:

a controller; and one or more processors, a non-transitory computer-readable medium storing instructions executable by the one or more processors to perform operations, the operations comprising:

receiving deflection data, wherein the deflection data contains at least a deflection angle; and transmitting instructions to a transceiver of the knuckle joint, wherein the instructions contain the deflection angle.

23. The alignment subsystem of claim 22, wherein the alignment subsystem is configured to move from a first position to a second position.

24. The alignment subsystem of claim 23, wherein in the first position, the running tool is aligned with the first axis.

25. The alignment subsystem of claim 23, wherein in the second position, the running tool is aligned with a second axis, wherein the second axis is parallel to the first axis and is offset from the first axis.

26. The alignment subsystem of claim 23, wherein the knuckle joint is configured to rotate to move the alignment subsystem from the first position to the second position.

27. The alignment subsystem of claim 23, wherein the knuckle joint is configured to rotate to move the alignment subsystem from the second position to the first position.

28. The alignment subsystem of claim 22, wherein the knuckle joint has a tensile capacity of about 10,000 psi to about 45,000 psi.

29. The alignment subsystem of claim 22, wherein the knuckle joint has a pressure capacity of about 3,000 psi to about 15,000 psi.

30. The alignment subsystem of claim 22, wherein the knuckle joint has a torsional capacity of about 5,000 ft-lb to about 20,000 ft-lb.

31. The alignment subsystem of claim 22, wherein the knuckle joint has a maximum deflection angle of about 5° to about 45°.

* * * * *